US012781649B2

(12) United States Patent
Anzai

(10) Patent No.: US 12,781,649 B2
(45) Date of Patent: Nov. 3, 2026

(54) VARIABLE VALVE TIMING MECHANISM

(71) Applicant: SUBARU CORPORATION, Tokyo (JP)

(72) Inventor: Hidenori Anzai, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 19/428,814

(22) Filed: Dec. 22, 2025

(65) Prior Publication Data

US 2026/0210276 A1 Jul. 23, 2026

(30) Foreign Application Priority Data

Jan. 21, 2025 (JP) ..... 2025-008489

(51) Int. Cl.
*F01L 1/344* (2006.01)
*F01L 1/24* (2006.01)
*F01L 13/00* (2006.01)

(52) U.S. Cl.
CPC ..... *F01L 1/3442* (2013.01); *F01L 2001/2438* (2013.01); *F01L 2001/34436* (2013.01); *F01L 2001/34463* (2013.01); *F01L 2013/10* (2013.01)

(58) Field of Classification Search
CPC combination set(s) only.
See application file for complete search history.

(56) References Cited

U.S. PATENT DOCUMENTS

2016/0108769 A1* 4/2016 Kobayashi ..... F01L 1/3442 123/90.17
2016/0130988 A1* 5/2016 Smith ..... F01L 1/34409 123/90.17
2017/0292415 A1* 10/2017 Sato ..... F01L 1/047
2019/0153910 A1* 5/2019 Asahi ..... F01L 1/356
2019/0186308 A1* 6/2019 Eriksson ..... F01L 1/3442
2021/0062689 A1* 3/2021 Oikawa ..... F01L 1/3442
2021/0277808 A1* 9/2021 Kenyon ..... F01L 1/34409
2022/0412235 A1* 12/2022 Kokumai ..... F01L 1/3442

FOREIGN PATENT DOCUMENTS

JP 2014-77434 A 5/2014

* cited by examiner

*Primary Examiner* — Binh Q Tran
(74) *Attorney, Agent, or Firm* — Rimon P.C.

(57) ABSTRACT

A variable valve timing mechanism includes a lock pin and a foreign matter discharge oil passage. An urging force of an urging member constituting the lock pin is set such that, when a hydraulic pressure applied to one end surface of the lock pin is equal to or higher than a first predetermined hydraulic pressure and lower than a second predetermined hydraulic pressure, the lock pin unlocks a housing and a rotor and interrupts communication between a lock oil passage and the foreign matter discharge oil passage. The urging force of the urging member is set such that, when the hydraulic pressure applied to the one end surface of the lock pin is equal to or higher than the second predetermined hydraulic pressure, the lock pin unlocks the housing and the rotor and causes the lock oil passage and the foreign matter discharge oil passage to communicate with each other.

7 Claims, 6 Drawing Sheets

VARIABLE VALVE TIMING MECHANISM

CROSS-REFERENCE TO RELATED APPLICATIONS

The present application claims priority from Japanese Patent Application No. 2025-008489 filed on Jan. 21, 2025, the entire contents of which are hereby incorporated by reference.

BACKGROUND

The disclosure relates to a hydraulic-vane variable valve timing mechanism.

Hitherto, there has been used a variable valve timing mechanism (active valve control system (AVCS)) in which a camshaft is advanced or retarded relative to a crankshaft depending on an operation state of an engine (for example, an engine speed or a load) to continuously change the valve opening/closing timings of intake and exhaust of the engine, thereby increasing intake and exhaust efficiencies in the entire engine speed range to improve output, improve fuel economy, and reduce exhaust gas.

The variable valve timing mechanism includes, for example, a housing that rotates in conjunction with the crankshaft of the engine, and a rotor (vanes) that is provided to be rotatable relative to the housing and rotates in conjunction with the camshaft. The variable valve timing mechanism varies the valve timing by relatively varying the amount of oil in an advance oil chamber and a retard oil chamber defined by the housing and the rotor (vanes) to rotationally adjust the phase difference between the housing and the rotor.

The variable valve timing mechanism includes a lock pin that fixes (locks) the housing and the rotor in order to fix the rotor at a predetermined position in a state in which the hydraulic pressure is low, for example, at the time of starting the engine (see, for example, Japanese Unexamined Patent Application Publication (JP-A) No. 2014-77434). For example, JP-A No. 2014-77434 discloses a valve opening/closing timing control device including a lock mechanism having a lock member and a lock recess that are disposed separately in a driving-side rotary member and a driven-side rotary member and can be inserted, engaged, and disengaged relative to each other to lock a rotational phase of the driven-side rotary member with respect to the driving-side rotary member at a predetermined phase, and a lock control unit that switches the lock mechanism between a locked state and an unlocked state by supplying and discharging a pressurized fluid to and from the lock recess.

SUMMARY

An aspect of the disclosure provides a variable valve timing mechanism including a housing, a rotor, an advance oil chamber, a retard oil chamber, and a controller. The housing is configured to rotate in conjunction with a crankshaft of an engine. The rotor is provided coaxially with the housing to be rotatable relative to the housing and is configured to rotate in conjunction with a camshaft. Oil is to enter the advance oil chamber to rotate the rotor to an advance side. The oil is to enter the retard oil chamber to rotate the rotor to a retard side. The advance oil chamber and the retard oil chamber are defined by the housing and the rotor. The controller is configured to control supply and discharge of the oil to and from the advance oil chamber and the retard oil chamber. The variable valve timing mechanism is configured to vary a valve timing by controlling the supply and discharge of the oil to and from the advance oil chamber and the retard oil chamber depending on an operation state of the engine to rotationally adjust a phase difference between the housing and the rotor. The variable valve timing mechanism includes a lock pin and a foreign matter discharge oil passage. The lock pin has one end coupled to a lock oil passage through which a hydraulic pressure is to be supplied, and has another end provided with an urging member configured to apply an urging force in a direction opposite to a direction of a pressing force of the hydraulic pressure. The lock pin is configured to slide in an axial direction according to a balance between the pressing force of the hydraulic pressure that is applied to one end surface and the urging force of the urging member that is applied to another end surface to lock the housing and the rotor or unlock the housing and the rotor. The foreign matter discharge oil passage makes communication between an outside and the lock oil passage through which the hydraulic pressure is to be supplied to the one end surface of the lock pin. The urging force of the urging member constituting the lock pin is set such that, when the hydraulic pressure applied to the one end surface of the lock pin is equal to or higher than a first predetermined hydraulic pressure and lower than a second predetermined hydraulic pressure, the lock pin unlocks the housing and the rotor and interrupts communication between the lock oil passage and the foreign matter discharge oil passage. The urging force of the urging member constituting the lock pin is set such that, when the hydraulic pressure applied to the one end surface of the lock pin is equal to or higher than the second predetermined hydraulic pressure, the lock pin unlocks the housing and the rotor and causes the lock oil passage and the foreign matter discharge oil passage to communicate with each other.

An aspect of the disclosure provides a variable valve timing mechanism including a housing, a rotor, an advance oil chamber, a retard oil chamber, and a controller. The housing is configured to rotate in conjunction with a crankshaft of an engine. The rotor is provided coaxially with the housing to be rotatable relative to the housing and is configured to rotate in conjunction with a camshaft. Oil is to enter the advance oil chamber to rotate the rotor to an advance side. The oil is to enter the retard oil chamber to rotate the rotor to a retard side. The advance oil chamber and the retard oil chamber are defined by the housing and the rotor. The controller is configured to control supply and discharge of the oil to and from the advance oil chamber and the retard oil chamber. The variable valve timing mechanism is configured to vary a valve timing by controlling the supply and discharge of the oil to and from the advance oil chamber and the retard oil chamber depending on an operation state of the engine to rotationally adjust a phase difference between the housing and the rotor. The variable valve timing mechanism includes a detent valve and a foreign matter discharge oil passage. The detent valve includes a spool having one end coupled to a detent oil passage through which a hydraulic pressure is to be supplied, and having another end provided with an urging member configured to apply an urging force in a direction opposite to a direction of a pressing force of the hydraulic pressure. The spool is configured to slide in an axial direction according to a balance between the pressing force of the hydraulic pressure that is applied to one end surface and the urging force of the urging member that is applied to another end surface to switch oil passages to move the rotor to a predetermined lock position or to allow the rotor to rotate. The foreign matter discharge oil passage makes communication between an outside and the detent oil passage through which the hydraulic pressure is to be supplied to the one end surface of the spool constituting the detent valve. The urging force of the urging member constituting the detent valve is set such that, when the hydraulic pressure applied to the one end surface of the spool constituting the detent valve is lower than a first predetermined hydraulic pressure, the detent valve switches the oil passages to move the rotor to the predetermined lock position and interrupts communication between the detent oil passage and the foreign matter discharge oil passage. The urging force of the urging member constituting the detent valve is set such that, when the hydraulic pressure applied to the one end surface of the spool constituting the detent valve is equal to or higher than the first predetermined hydraulic pressure and lower than a second predetermined hydraulic pressure, the detent valve switches the oil passages to allow the rotor to rotate and interrupts the communication between the detent oil passage and the foreign matter discharge oil passage. The urging force of the urging member constituting the detent valve is set such that, when the hydraulic pressure applied to the one end surface of the spool constituting the detent valve is equal to or higher than the second predetermined hydraulic pressure, the detent valve switches the oil passages to allow the rotor to rotate and causes the detent oil passage and the foreign matter discharge oil passage to communicate with each other.

BRIEF DESCRIPTION OF THE DRAWINGS

The accompanying drawings are included to provide a further understanding of the disclosure and are incorporated in and constitute a part of this specification. The drawings illustrate an embodiment and, together with the specification, serve to describe the principles of the disclosure.

DETAILED DESCRIPTION

Since the lock pin that fixes (locks) the housing and the rotor switches the locked state and the unlocked state by sliding in an axial direction depending on the hydraulic pressure, there is a concern that a malfunction may occur due to biting of foreign matter (contamination) in the oil (for example, sticking due to foreign matter biting into a sliding portion).

It is desirable to provide a variable valve timing mechanism that can suppress occurrence of a malfunction of a lock pin or the like due to biting of foreign matter (contamination) in oil.

In the following, an embodiment of the disclosure is described in detail with reference to the accompanying drawings. Note that the following description is directed to an illustrative example of the disclosure and not to be construed as limiting to the disclosure. Factors including, without limitation, numerical values, shapes, materials, components, positions of the components, and how the components are coupled to each other are illustrative only and not to be construed as limiting to the disclosure. Further, elements in the following example embodiment which are not recited in a most-generic independent claim of the disclosure are optional and may be provided on an as-needed basis. The drawings are schematic and are not intended to be drawn to scale. Throughout the present specification and the drawings, elements having substantially the same function and configuration are denoted with the same numerals to avoid any redundant description.

Figure 1:
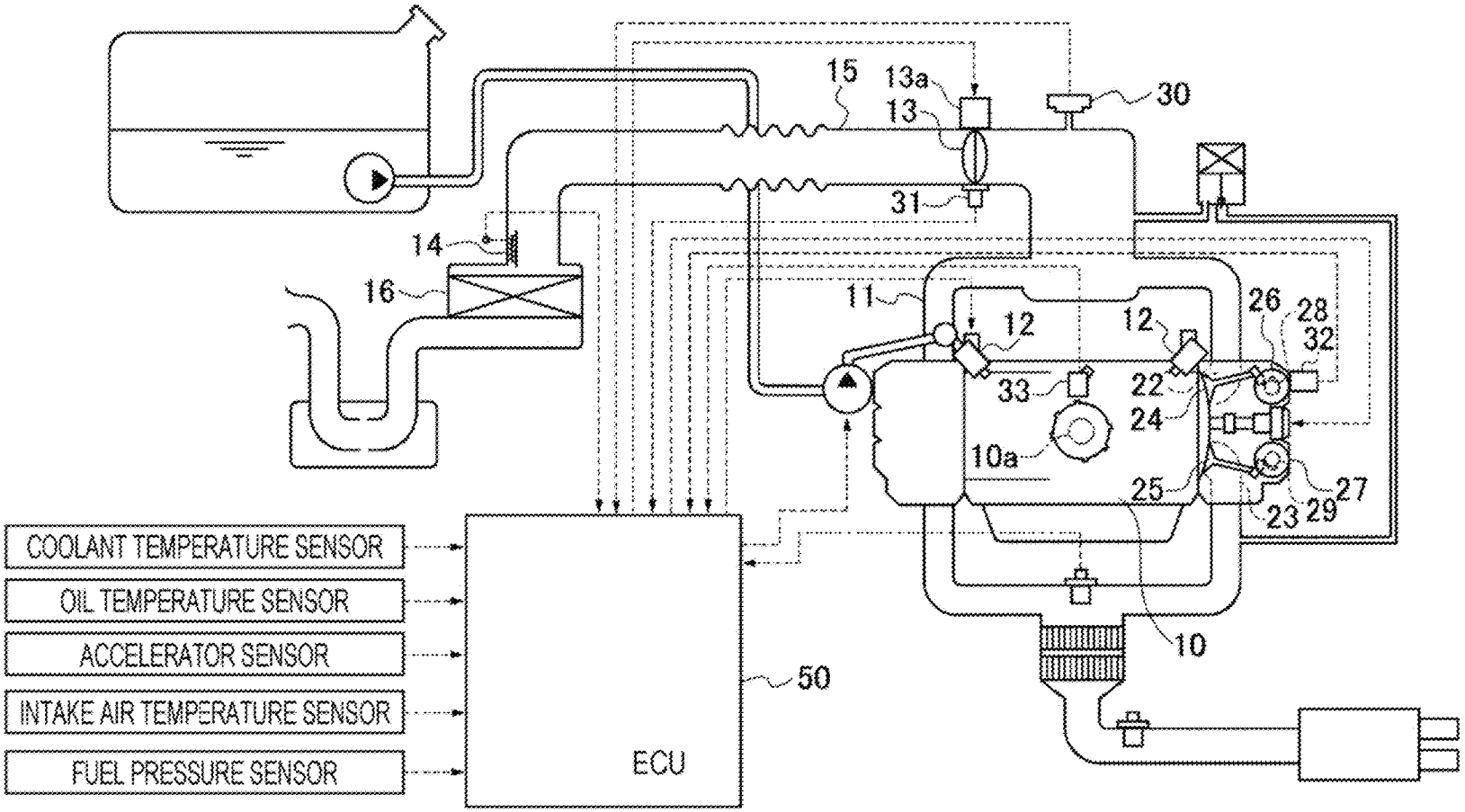
FIG. 1 is a diagram illustrating a configuration of an engine to which a variable valve timing mechanism according to an embodiment of the disclosure is applied.
Figure 2:
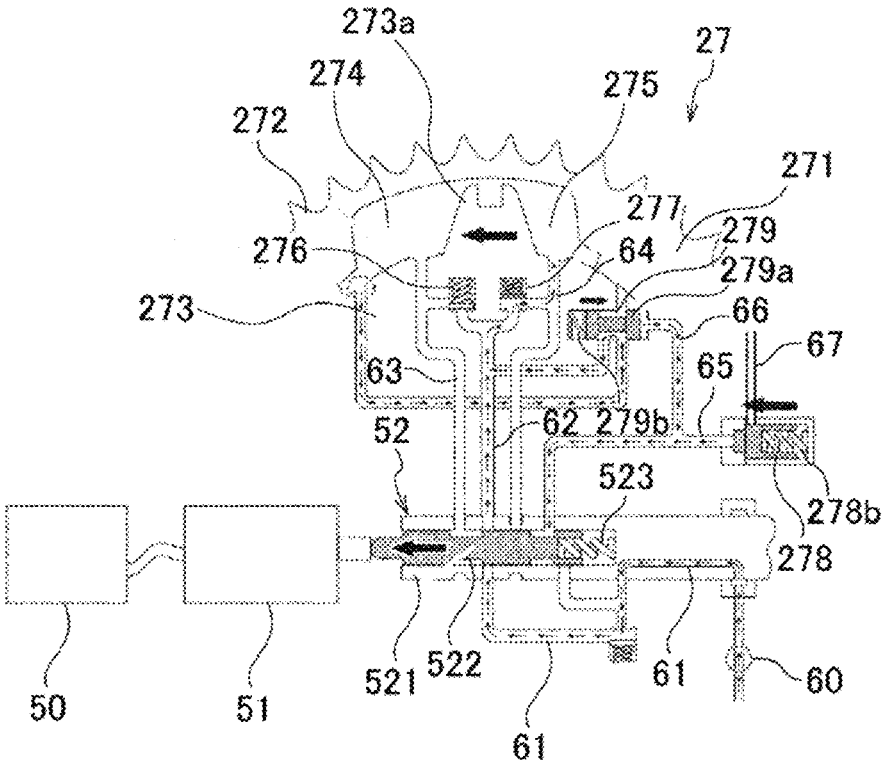
FIG. 2 is a diagram illustrating the configuration (rotor-locked state) of the variable valve timing mechanism according to the embodiment.
Figure 3:
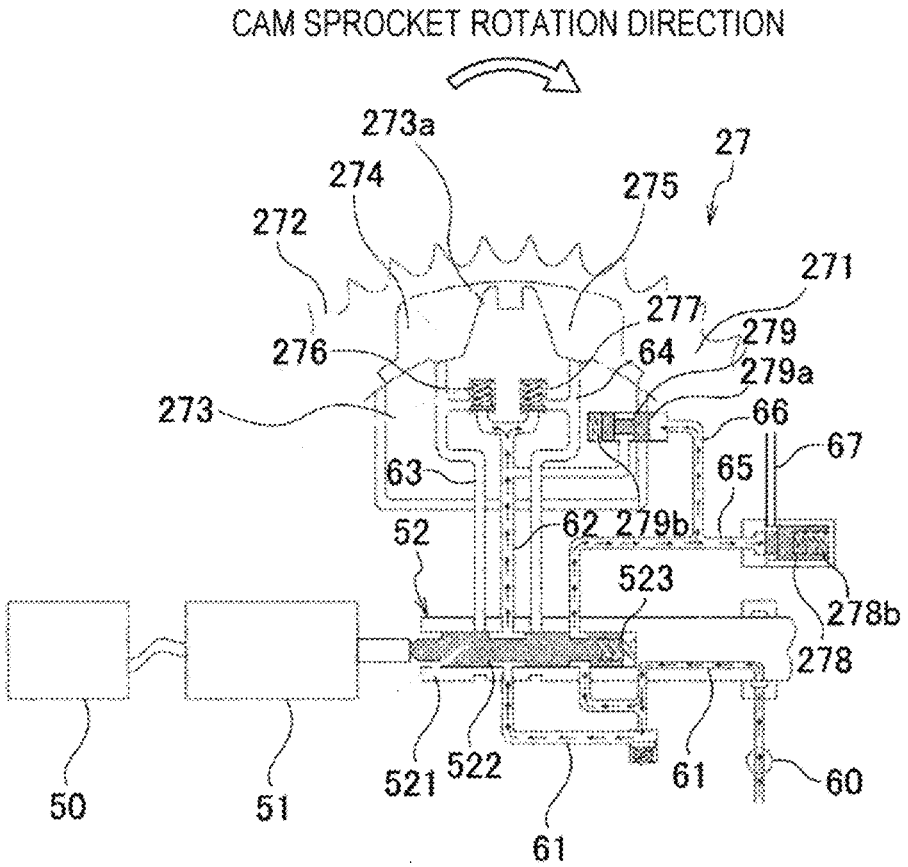
FIG. 3 is a diagram illustrating the configuration (rotor-rotatable state) of the variable valve timing mechanism according to the embodiment.

First, the configuration of a variable valve timing mechanism 27 according to the embodiment will be described with reference to FIG. 1 to FIG. 3. FIG. 1 is a diagram illustrating a configuration of a cylinder injection engine (hereinafter also simply referred to as "engine") 10 to which the variable valve timing mechanism 27 is applied. FIG. 2 is a diagram illustrating the configuration (rotor-locked state) of the variable valve timing mechanism 27. FIG. 3 is a diagram illustrating the configuration (rotor-rotatable state) of the variable valve timing mechanism 27.

The engine 10 is, for example, a horizontally-opposed four-cylinder gasoline engine. The engine 10 is a cylinder injection engine that directly injects fuel into the cylinder. In the engine 10, air taken in from an air cleaner 16 is throttled by an electronically-controlled throttle valve (hereinafter also simply referred to as "throttle valve") 13 provided in an intake pipe 15, passes through an intake manifold 11, and is taken into each cylinder formed in the engine 10. The amount of air taken in from the air cleaner 16 (intake air amount of the engine 10) is detected by an air flow meter 14 disposed between the air cleaner 16 and the throttle valve 13. A vacuum sensor 30 that detects the pressure in the intake manifold 11 is disposed in a collector portion (surge tank) constituting the intake manifold 11. The throttle valve 13 is provided with a throttle opening degree sensor 31 that detects the opening degree of the throttle valve 13.

A cylinder head has an intake port 22 and an exhaust port 23 for each cylinder (only one bank is illustrated in FIG. 1). The intake port 22 and the exhaust port 23 are provided with an intake valve 24 and an exhaust valve 25 that open and close the intake port 22 and the exhaust port 23, respectively.

A variable valve timing mechanism 26 is disposed between an intake camshaft 28 and an intake cam pulley that drive the intake valve 24. The variable valve timing mechanism 26 rotates the intake cam pulley and the intake camshaft 28 relative to each other to continuously change the rotational phase (displacement angle) of the intake camshaft 28 with respect to a crankshaft 10*a*, thereby advancing or retarding the valve timing (opening/closing timing) of the intake valve 24. The variable valve timing mechanism 26 variably sets the opening/closing timing of the intake valve 24 depending on an operation state of the engine 10.

Similarly, the variable valve timing mechanism 27 is disposed between an exhaust camshaft 29 and an exhaust cam pulley (chain sprocket 272). The variable valve timing mechanism 27 rotates the exhaust cam pulley (chain sprocket 272) and the exhaust camshaft 29 relative to each other to continuously change the rotational phase (displacement angle) of the exhaust camshaft 29 with respect to the crankshaft 10*a*, thereby advancing or retarding the valve timing (opening/closing timing) of the exhaust valve 25. The variable valve timing mechanism 27 variably sets the opening/closing timing of the exhaust valve 25 depending on the operation state of the engine 10.

Since the configuration of the variable valve timing mechanism 26 provided on the intake valve 24 side and the configuration of the variable valve timing mechanism 27 provided on the exhaust valve 25 side are the same or similar, the variable valve timing mechanism 27 provided on the exhaust valve 25 side will be mainly described below as an example.

As illustrated in FIG. 2 and FIG. 3, the variable valve timing mechanism 27 provided on the exhaust valve 25 side includes a housing 271 that rotates in conjunction with the crankshaft 10*a* of the engine 10, and a rotor 273 that is provided coaxially with the housing 271 to be rotatable relative to the housing 271 and rotates in conjunction with the exhaust camshaft 29.

More specifically, the chain sprocket 272 having a plurality of external teeth formed on the outer circumference in the radial direction is fixed to the housing 271, and the power of the crankshaft 10*a* is transmitted through the chain sprocket 272. The housing 271 rotates at half the rotational speed of the crankshaft 10*a*.

In order to house the rotor 273, a housing space including a circular space and a plurality of (for example, three) fan-shaped spaces formed by cutting the circular space radially outward in a fan shape is formed inside the housing 271. The rotor 273 is housed in the housing space provided in the housing 271 and is coupled to the end of the exhaust camshaft 29. A plurality of (three in the present embodiment) vanes 273*a* that protrudes radially outward and is housed in the fan-shaped spaces is formed on the outer surface of the rotor 273. The rotor 273 can rotate relative to the housing 271 within a range in which the vanes 273*a* can move in the fan-shaped spaces.

In the variable valve timing mechanism 27, the housing 271 and the rotor 273 (vane 273*a*) define an advance oil chamber (hydraulic chamber) 274 that oil (hydraulic pressure) for rotating the rotor 273 to an advance side is to enter, and a retard oil chamber (hydraulic chamber) 275 that oil (hydraulic pressure) for rotating the rotor 273 to a retard side is to enter. More specifically, the vane 273*a* is narrower in the rotational direction than the fan-shaped space, and divides the fan-shaped space into the advance oil chamber 274 (hydraulic chamber for operating the rotor 273 in the advance direction) and the retard oil chamber 275 (hydraulic chamber for operating the rotor 273 in the retard direction). The advance direction is a rightward direction in FIG. 2 and FIG. 3, and the retard direction is a leftward direction in FIG. 2 and FIG. 3.

Supply and discharge of oil to and from the advance oil chamber 274 and the retard oil chamber 275, that is, adjustment of an oil amount (valve timing), is controlled by an engine control unit (hereinafter referred to as "ECU") 50, a linear solenoid 51, and an oil control valve 52. In one embodiment, the ECU 50, the linear solenoid 51, and the oil control valve 52 serve as a "controller."

The oil control valve 52 includes a sleeve 521 having a plurality of ports, and a spool 522 housed in the sleeve 521 to be slidable in the axial direction. The ports of the sleeve 521 are coupled to a first supply oil passage 61 through which oil is supplied into the sleeve 521 by an oil pump 60, a second supply oil passage 62 through which oil is supplied to the advance oil chamber 274 or the retard oil chamber 275, a first drain oil passage 63 through which oil is discharged from the advance oil chamber 274, a second drain oil passage 64 through which oil is discharged from the retard oil chamber 275, a detent oil passage 66 through which oil (hydraulic pressure) is supplied to and discharged from a detent valve 279, and a lock oil passage 65 (a common portion is shared between the detent oil passage 66 and the lock oil passage 65) through which oil (hydraulic pressure) is supplied to and discharged from a lock pin 278. The oil pump 60 pressurizes oil stored in an oil pan and discharges the pressurized oil.

A spring 523 is disposed at one end of the spool 522, and the linear solenoid 51 is disposed at the other end of the spool 522. The spool 522 is driven in the axial direction by the resultant force of the driving force of the linear solenoid 51 and the urging force of the spring 523, whereby the supply and discharge (movement) of oil are controlled.

The linear solenoid 51 is coupled to the ECU 50, and the drive is controlled by the ECU 50. The linear solenoid 51 displaces a shaft in the axial direction based on the value of a current applied from the ECU 50, thereby driving the spool 522 in the axial direction (lateral direction in FIG. 2 and FIG. 3). More specifically, when the current supplied to the linear solenoid 51 is smaller than a predetermined value, that is, when the drive of the linear solenoid 51 is stopped, the spool 522 moves leftward in the figure by the urging force of the spring 523. When the current supplied to the linear solenoid 51 is larger than the predetermined value, that is, when the linear solenoid 51 is driven, the spool 522 moves rightward in the figure. Instead of the linear solenoid 51, for example, a duty solenoid may be used.

The ECU 50 includes a microprocessor that performs calculation, an EEPROM that stores a program or the like for causing the microprocessor to execute each process, a RAM that stores various types of data such as calculation results, a backup RAM that holds storage contents by a battery, an input/output I/F, and the like. The ECU 50 includes an injector driver that drives injectors 12, an output circuit that outputs an ignition signal, and a motor driver that drives an electric motor 13*a* that opens and closes the electronically-controlled throttle valve 13. The ECU 50 further includes a driver that drives the linear solenoid 51 constituting the variable valve timing mechanism 27.

In the ECU 50, the cylinder is discriminated from an output of a cam angle sensor 32, and the engine speed is determined from an output of a crank angle sensor 33. In the ECU 50, various types of information such as an intake air amount, an intake pipe negative pressure, an accelerator operation amount, an air-fuel ratio of an air-fuel mixture, an intake air temperature, and a coolant temperature and an oil temperature of the engine 10 are acquired based on detection signals input from various sensors. The ECU 50 comprehensively controls the engine 10 by controlling a fuel injection amount, a fuel injection timing, an ignition timing, and various devices such as the throttle valve 13 based on the acquired various types of information.

The ECU 50 controls the supply and discharge of oil (amount of oil) to and from the advance oil chamber 274 and the retard oil chamber 275 of the variable valve timing mechanism 27 depending on the operation state of the engine 10 (for example, the engine speed or the load), and rotationally adjusts the phase difference between the housing 271 and the rotor 273, thereby varying the valve timing.

More specifically, the ECU 50 drives the linear solenoid 51 to move the spool 522 rightward in the figure, thereby discharging oil from the retard oil chamber 275 and supplying (moving) the oil to the advance oil chamber 274 (that is, driving the variable valve timing mechanism 27 to the advance side). The ECU 50 stops the drive of the linear solenoid 51 to move the spool 522 leftward in the figure, thereby discharging oil from the advance oil chamber 274 and supplying (moving) the oil to the retard oil chamber 275 (that is, driving the variable valve timing mechanism 27 to the retard side).

At this time, the ECU 50 moves the linear solenoid 51 (spool 522) such that the target angle and the actual angle (sensor value) of the rotor 273 (vane 273*a*) coincide with each other. A cam torque is used as a driving force for moving the oil. Although the cam torque is input alternately, the state is maintained by closing an advance side check valve 276 or a retard side check valve 277 at the time of reverse torque.

The variable valve timing mechanism includes the detent valve 279 that moves the rotor 273 to a predetermined lock position (for example, a neutral position) and the lock pin 278 that fixes (locks) the housing 271 and the rotor 273 at the predetermined lock position in order to fix the rotor 273 at the predetermined position in a state in which the hydraulic pressure is low, for example, at the time of starting the engine.

The detent valve 279 includes a spool 279*a* that has one end coupled to the detent oil passage 66 through which the hydraulic pressure is supplied, has the other end provided with an urging member (for example, a spring) 279*b* that applies an urging force in a direction opposite to that of the pressing force of the hydraulic pressure, and is housed to be slidable in the axial direction. In the detent valve 279, the hydraulic pressure is applied to (acts on) one end surface, and the urging force of the urging member 279*b* (urging force in the direction opposite to that of the pressing force of the hydraulic pressure) is applied to (acts on) the other end surface. The spool 279*a* slides in the axial direction according to the balance between the pressing force of the hydraulic pressure and the urging force of the urging member 279*b* to switch the oil passages such that the rotor 273 moves to the predetermined lock position (for example, the neutral position) or switch the oil passages such that the rotor 273 becomes rotatable (freely rotates).

The lock pin 278 has one end coupled to the lock oil passage 65 through which the hydraulic pressure is supplied, has the other end provided with an urging member (for example, a spring) 278*b* that applies an urging force in a direction opposite to that of the pressing force of the hydraulic pressure, and is housed to be slidable in the axial direction. In the lock pin 278, the hydraulic pressure is applied to (acts on) one end surface, and the urging force of the urging member 278*b* (urging force in the direction opposite to that of the pressing force of the hydraulic pressure) is applied to (acts on) the other end surface. The lock pin 278 slides in the axial direction according to the balance between the pressing force of the hydraulic pressure and the urging force of the urging member 278*b* to lock the housing 271 and the rotor 273 or unlock the housing 271 and the rotor 273.

In this way, the detent valve 279 and the lock pin 278 are released by the hydraulic pressures, and are operated by the urging forces of the urging members 279*b* and 278*b* (spring forces of the springs). Since it is necessary to maintain the hydraulic pressure in order to maintain the unlocked state of the rotor 273 (rotatable state of the rotor 273), the detent oil passage 66 and the lock oil passage 65 form a closed circuit.

More specifically, when the supply of the hydraulic pressure from the oil control valve 52 is stopped, as illustrated in FIG. 2, the detent valve 279 is operated (the spool 279*a* slides) by the urging force of the urging member 279*b*, and the rotor 273 is moved to the lock position (for example, the neutral position). FIG. 2 illustrates a state in which the oil flows into the retard oil chamber 275 through the detent valve 279. When the supply of the hydraulic pressure from the oil control valve 52 is stopped, the lock pin 278 is inserted into a lock hole 651 by the urging force of the urging member 278*b* (details will be described later), and the rotation of the rotor 273 relative to the housing 271 is mechanically locked (that is, the housing 271 and the rotor 273 are fixed (locked)).

When the hydraulic pressure (hydraulic pressure of the oil pump 60) is supplied from the oil control valve 52, as illustrated in FIG. 3, the operation of the detent valve 279 is stopped by the hydraulic pressure (thus, the rotor 273 becomes rotatable). When the hydraulic pressure (hydraulic pressure of the oil pump 60) is supplied from the oil control valve 52, the hydraulic pressure is supplied to the lock hole 651 (one end of the lock pin 278) via the lock oil passage 65, the lock pin 278 is pushed out of the lock hole 651 against the urging force of the urging member 278*b*, and the lock of the rotor 273 is released (the rotor 273 is unlocked).

In particular, the variable valve timing mechanism 27 has a function of suppressing occurrence of malfunctions of the lock pin 278 and the detent valve 279 due to biting of foreign matter (contamination) in the oil. The tip (corner) of the lock pin 278 is formed in a tapered shape in order to facilitate insertion into the lock hole 651, and biting of foreign matter is likely to occur. Since the configuration for suppressing occurrence of a malfunction of the lock pin 278 due to biting of foreign matter and the configuration for suppressing occurrence of a malfunction of the detent valve 279 due to biting of foreign matter are the same or similar, the lock pin 278 will be mainly described below as an example.

In order to suppress occurrence of a malfunction of the lock pin 278 due to biting of foreign matter, the variable valve timing mechanism 27 includes a foreign matter discharge oil passage (drain circuit) 67 that makes communication between the outside and the lock oil passage 65 through which the lock hydraulic pressure is supplied to one end surface of the lock pin 278 (that is, discharges the oil to the outside).

For example, the other end of the foreign matter discharge oil passage 67 communicates with a crankcase, and the oil is discharged to the crankcase. The oil (oil containing foreign matter) discharged to the crankcase is returned from the crankcase to the oil pan that stores the oil. Then, the foreign matter (contamination) in the oil is trapped by a strainer, an oil filter, or the like.

The diameter of the foreign matter discharge oil passage 67 is set smaller than the diameter of the lock pin 278. For example, when the diameter φ of the lock pin 278 is set to about 5 mm, the diameter φ of the foreign matter discharge oil passage 67 is preferably set to about 1 mm. The urging force of the urging member 278*b* (spring force of the spring) constituting the lock pin 278 is set to satisfy all of the following conditions (1) to (3). It is preferable that the urging force of the urging member 278*b* (spring constant of the spring) be adjusted (the spring constant be increased) by changing (increasing) the wire diameter of the spring or changing (increasing) the number of turns. It is preferable that the stroke of the lock pin 278 be increased by, for example, about several millimeters as compared with the case where the foreign matter discharge oil passage 67 is not provided.

(1) The urging force of the urging member 278*b* (spring constant of the spring) is set such that the lock pin 278 locks the housing 271 and the rotor 273 and interrupts the communication between the lock oil passage 65 and the foreign matter discharge oil passage 67 when the hydraulic pressure applied to (acting on) one end surface of the lock pin 278 is lower than a first predetermined hydraulic pressure (when the supply of the hydraulic pressure from the oil control valve 52 is stopped).

(2) The urging force of the urging member 278*b* (spring constant of the spring) is set such that the lock pin 278 unlocks the housing 271 and the rotor 273 and interrupts the communication between the lock oil passage 65 and the foreign matter discharge oil passage 67 when the hydraulic pressure applied to (acting on) one end surface of the lock pin 278 (hydraulic pressure supplied from the oil control valve 52) is equal to or higher than the first predetermined hydraulic pressure and lower than a second predetermined hydraulic pressure.

(3) The urging force of the urging member 278*b* (spring constant of the spring) is set such that the lock pin 278 unlocks the housing 271 and the rotor 273 and causes the lock oil passage 65 and the foreign matter discharge oil passage 67 to communicate with each other when the hydraulic pressure applied to (acting on) one end surface of the lock pin 278 (hydraulic pressure supplied from the oil control valve 52) is equal to or higher than the second predetermined hydraulic pressure.

As described above, the oil pump 60 is driven by the engine 10 to pressurize and discharge the oil. The discharge pressure of the oil pump 60 is set equal to or higher than the second predetermined hydraulic pressure (>first predetermined pressure), for example, when the oil temperature is lower than a predetermined oil temperature (for example, 20° C.) (low oil temperature) and/or when the rotational speed is equal to or higher than a predetermined rotational speed (for example, 4000 rpm) (high rotational speed). For example, when the rotational speed is 4000 rpm and the oil temperature is 80° C. to 90° C. or when the rotational speed is 1000 rpm and the oil temperature is 20° C., the discharge pressure of the oil pump 60 is equal to or higher than the second predetermined hydraulic pressure (that is, the hydraulic pressure has a margin). When the hydraulic pressure is supplied from the oil control valve 52 to the lock pin 278 in this state, the rotor 273 is unlocked and the foreign matter discharge oil passage 67 is brought into communication.

The discharge pressure of the oil pump 60 is set lower than the second predetermined hydraulic pressure and equal to or higher than the first predetermined hydraulic pressure, for example, when the oil temperature is equal to or higher than the predetermined oil temperature (for example, 20° C.) (high oil temperature) and/or when the rotational speed is lower than the predetermined rotational speed (for example, 4000 rpm) (low rotational speed). For example, when the rotational speed is 1000 rpm and the oil temperature is 80° C. to 90° C., the discharge pressure of the oil pump 60 is lower than the second predetermined hydraulic pressure and equal to or higher than the first predetermined hydraulic pressure (that is, the hydraulic pressure has a small margin). When the hydraulic pressure is supplied from the oil control valve 52 to the lock pin 278 in this state, the rotor 273 is unlocked and the communication of the foreign matter discharge oil passage 67 is interrupted.

With the above configuration, the lock pin 278 operates as follows.

Figure 4:
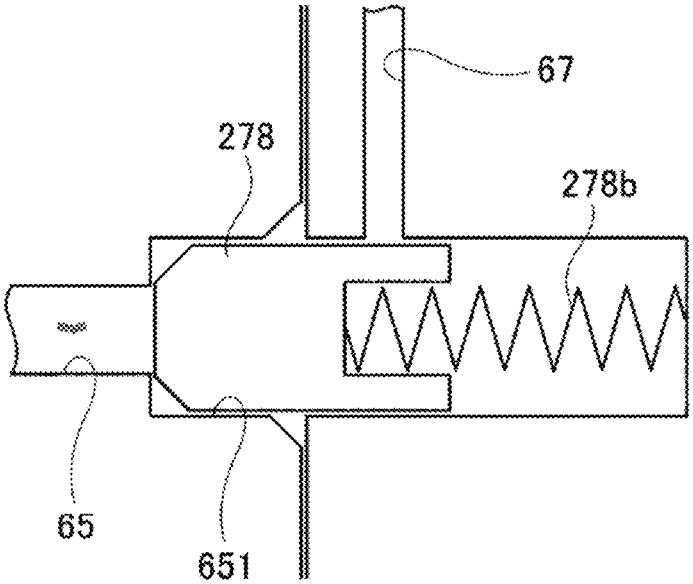
FIG. 4 is a diagram illustrating a configuration (locking and foreign matter discharge oil passage communication interrupted state) of a lock pin.

(1) When the oil control valve 52 is turned off (the supply of the hydraulic pressure is stopped) and the hydraulic pressure applied to one end surface of the lock pin 278 is lower than the first predetermined hydraulic pressure, as illustrated in FIG. 4, the housing 271 and the rotor 273 are locked by the lock pin 278, and the communication between the lock oil passage 65 and the foreign matter discharge oil passage 67 is interrupted.

Figure 5:
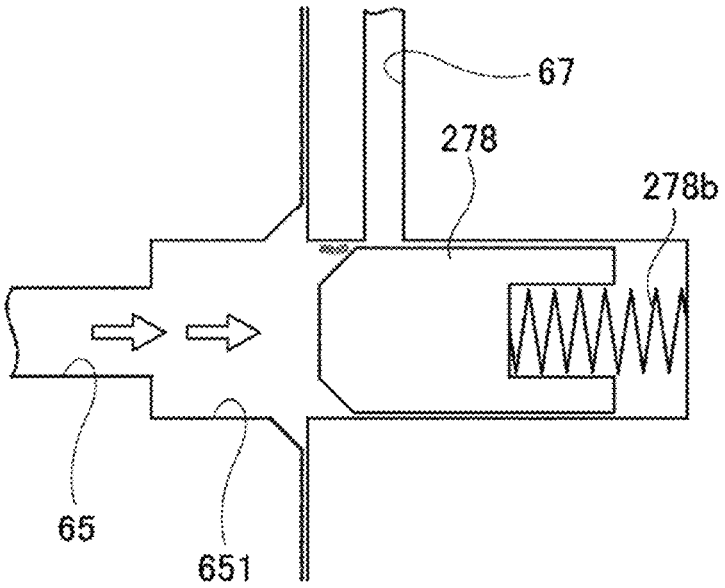
FIG. 5 is a diagram illustrating the configuration (unlocking and foreign matter discharge oil passage communication interrupted state) of the lock pin.

(2) When the oil control valve 52 is turned on (the hydraulic pressure is supplied) and the hydraulic pressure applied to one end surface of the lock pin 278 is equal to or higher than the first predetermined hydraulic pressure and lower than the second predetermined hydraulic pressure (the hydraulic pressure has a small margin), as illustrated in FIG. 5, the housing 271 and the rotor 273 are unlocked by the lock pin 278, and the communication between the lock oil passage 65 and the foreign matter discharge oil passage 67 is interrupted.

Figure 6:
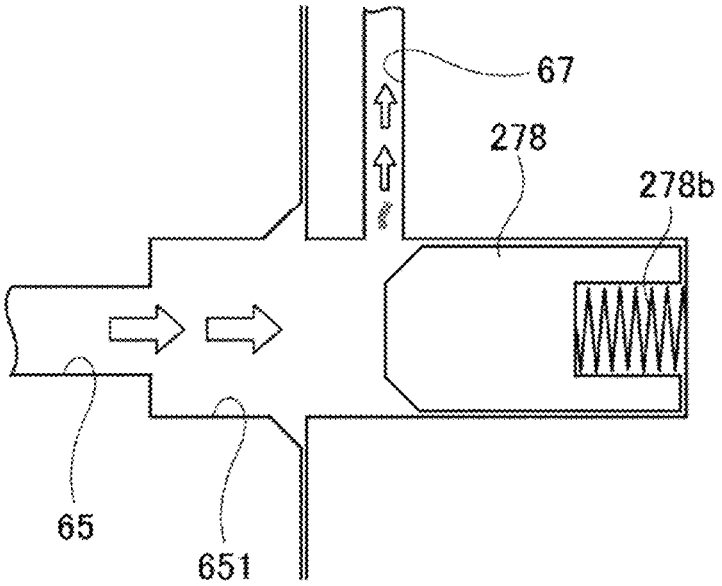
FIG. 6 is a diagram illustrating the configuration (unlocking and foreign matter discharge oil passage communicating state) of the lock pin.

(3) When the oil control valve 52 is turned on (the hydraulic pressure is supplied) and the hydraulic pressure applied to one end surface of the lock pin 278 is equal to or higher than the second predetermined hydraulic pressure (>first predetermined pressure) (the hydraulic pressure has a margin), as illustrated in FIG. 6, the housing 271 and the rotor 273 are unlocked by the lock pin 278, and the lock oil passage 65 and the foreign matter discharge oil passage 67 communicate with each other. Then, the foreign matter is discharged together with the oil.

As described above in detail, the present embodiment provides the lock pin 278 that slides in the axial direction according to the balance between the pressing force of the hydraulic pressure applied to one end surface and the urging force of the urging member 278*b* applied to the other end surface, and the foreign matter discharge oil passage 67 that makes communication between the outside and the lock oil passage 65 through which the hydraulic pressure is supplied to one end surface of the lock pin 278. The urging force of the urging member 278*b* is set such that the lock pin 278 unlocks the housing 271 and the rotor 273 and causes the lock oil passage 65 and the foreign matter discharge oil passage 67 to communicate with each other when the hydraulic pressure applied to one end surface of the lock pin 278 is equal to or higher than the second predetermined hydraulic pressure. When the hydraulic pressure is equal to or higher than the second predetermined hydraulic pressure (that is, the hydraulic pressure has a margin), the foreign matter (contamination) can be discharged to the outside together with the oil through the foreign matter discharge oil passage 67. As a result, it is possible to suppress the occurrence of a malfunction of the lock pin 278 due to biting of the foreign matter (contamination) in the oil.

When the hydraulic pressure applied to one end surface of the lock pin 278 is equal to or higher than the first predetermined hydraulic pressure and lower than the second predetermined hydraulic pressure, the lock pin 278 unlocks the housing 271 and the rotor 273 and interrupts the communication between the lock oil passage 65 and the foreign matter discharge oil passage 67. When the hydraulic pressure has a small margin, the hydraulic pressure can be maintained by stopping the discharge of the oil.

According to the present embodiment, the urging force of the urging member 278*b* is set such that the lock pin 278 locks the housing 271 and the rotor 273 and interrupts the communication between the lock oil passage 65 and the foreign matter discharge oil passage 67 when the hydraulic pressure applied to one end surface of the lock pin 278 is lower than the first predetermined hydraulic pressure. Therefore, the rotor 273 can be locked by stopping the supply of the hydraulic pressure to the lock pin 278.

According to the present embodiment, the discharge pressure of the oil pump 60 is set equal to or higher than the second predetermined hydraulic pressure (>first predetermined pressure) when the oil temperature is lower than the predetermined oil temperature (low oil temperature) and/or when the rotational speed is equal to or higher than the predetermined rotational speed (high rotational speed). The discharge pressure of the oil pump 60 is set lower than the second predetermined hydraulic pressure and equal to or higher than the first predetermined hydraulic pressure when the oil temperature is equal to or higher than the predetermined oil temperature (high oil temperature) and/or when the rotational speed is lower than the predetermined rotational speed (low rotational speed). Therefore, the foreign matter discharge oil passage 67 can be brought into communication when the oil temperature is lower than the predetermined oil temperature and/or when the rotational speed is equal to or higher than the predetermined rotational speed (that is, the hydraulic pressure has a margin), and the communication of the foreign matter discharge oil passage 67 can be interrupted when the oil temperature is equal to or higher than the predetermined oil temperature and/or when the rotational speed is lower than the predetermined rotational speed (that is, the hydraulic pressure has a small margin.

According to the present embodiment, the other end of the foreign matter discharge oil passage 67 communicates with the crankcase, and the oil containing the foreign matter is discharged to the crankcase. Therefore, the oil containing the foreign matter can be discharged from the crankcase to the oil pan that stores the oil. Then, the foreign matter (contamination) in the oil can be trapped by the strainer, the oil filter, or the like.

Instead of or in addition to the foreign matter discharge oil passage 67 that makes communication between the outside and the lock oil passage 65 through which the hydraulic pressure is supplied to the lock pin 278, a foreign matter discharge oil passage (drain circuit) 67 that makes communication between the outside and the detent oil passage 66 through which the hydraulic pressure is supplied to one end surface of the detent valve 279 (spool 279*a*) may be provided.

In this case, the urging force of the urging member 279*b* constituting the detent valve 279 is set such that the detent valve 279 (spool 279*a*) switches the oil passages to move the rotor 273 to the predetermined lock position and interrupts the communication between the detent oil passage 66 and the foreign matter discharge oil passage 67 when the hydraulic pressure applied to one end surface of the spool 279*a* constituting the detent valve 279 is lower than the first predetermined hydraulic pressure, such that the detent valve 279 switches the oil passages to allow the rotor 273 to rotate and interrupts the communication between the detent oil passage 66 and the foreign matter discharge oil passage 67 when the hydraulic pressure applied to one end surface of the spool 279*a* is equal to or higher than the first predetermined hydraulic pressure and lower than the second predetermined hydraulic pressure, and such that the detent valve 279 switches the oil passages to allow the rotor 273 to rotate and causes the detent oil passage 66 and the foreign matter discharge oil passage 67 to communicate with each other when the hydraulic pressure applied to one end surface of the spool 279*a* is equal to or higher than the second predetermined hydraulic pressure.

Since the other configuration is the same as or similar to that of the lock pin 278 described above, the detailed description thereof will be omitted.

In this way, it is possible to suppress the occurrence of a malfunction of the detent valve 279 due to biting of the foreign matter in the oil as in the case of the lock pin 278 described above.

Although the embodiment of the disclosure is described above, the embodiment of the disclosure is not limited to the above embodiment, and various modifications may be made. For example, the embodiment of the disclosure is applied to the variable valve timing mechanism 27 on the exhaust valve 25 side, but may be applied to the variable valve timing mechanism 26 on the intake valve 24 side instead of or in addition to the variable valve timing mechanism 27.

The pipe shape and diameter of the foreign matter discharge oil passage (drain circuit) 67 are not limited to those in the above embodiment, and may be optionally set depending on requirements and the like.

For example, a plurality of detent valves 279 and a plurality of lock pins 278 may be provided in accordance with the number of rotors 273.

The dimensions, materials (raw materials), other specific numerical values, and the like described in the above embodiment are examples for facilitating understanding of the embodiment of the disclosure, and do not limit the embodiment of the disclosure unless otherwise specified.

The variable valve timing mechanism according to the aspect of the disclosure includes the lock pin and the foreign matter discharge oil passage. The lock pin has the one end coupled to the lock oil passage through which the hydraulic pressure is to be supplied, and has the other end provided with the urging member configured to apply the urging force in the direction opposite to the direction of the pressing force of the hydraulic pressure. The lock pin is configured to slide in the axial direction according to the balance between the pressing force of the hydraulic pressure that is applied to the one end surface and the urging force of the urging member that is applied to the other end surface to lock the housing and the rotor or unlock the housing and the rotor. The foreign matter discharge oil passage makes communication between the outside and the lock oil passage through which the hydraulic pressure is to be supplied to the one end surface of the lock pin. The urging force of the urging member constituting the lock pin is set such that, when the hydraulic pressure applied to the one end surface of the lock pin is equal to or higher than the second predetermined hydraulic pressure, the lock pin unlocks the housing and the rotor and causes the lock oil passage and the foreign matter discharge oil passage to communicate with each other. When the hydraulic pressure is equal to or higher than the second predetermined hydraulic pressure (that is, the hydraulic pressure has a margin), the foreign matter (contamination) can be discharged to the outside together with the oil through the foreign matter discharge oil passage. When the hydraulic pressure applied to the one end surface of the lock pin is equal to or higher than the first predetermined hydraulic pressure and lower than the second predetermined hydraulic pressure, the lock pin unlocks the housing and the rotor and interrupts the communication between the lock oil passage and the foreign matter discharge oil passage. When the hydraulic pressure has a small margin, the hydraulic pressure can be maintained by stopping the discharge of the oil.

According to the embodiment of the disclosure, it is possible to suppress the occurrence of a malfunction of the lock pin or the like due to biting of the foreign matter (contamination) in the oil.

The invention claimed is:

1. A variable valve timing mechanism including a housing configured to rotate in conjunction with a crankshaft of an engine, a rotor that is provided coaxially with the housing to be rotatable relative to the housing and is configured to rotate in conjunction with a camshaft, an advance oil chamber that oil is to enter to rotate the rotor to an advance side, a retard oil chamber that the oil is to enter to rotate the rotor to a retard side, the advance oil chamber and the retard oil chamber being defined by the housing and the rotor, and a controller configured to control supply and discharge of the oil to and from the advance oil chamber and the retard oil chamber, the variable valve timing mechanism being configured to vary a valve timing by controlling the supply and discharge of the oil to and from the advance oil chamber and the retard oil chamber depending on an operation state of the engine to rotationally adjust a phase difference between the housing and the rotor, the variable valve timing mechanism comprising:

a lock pin having one end coupled to a lock oil passage through which a hydraulic pressure is to be supplied, and having another end provided with an urging member configured to apply an urging force in a direction opposite to a direction of a pressing force of the hydraulic pressure, the lock pin being configured to slide in an axial direction according to a balance between the pressing force of the hydraulic pressure that is applied to one end surface and the urging force of the urging member that is applied to another end surface to lock the housing and the rotor or unlock the housing and the rotor; and a foreign matter discharge oil passage that makes communication between an outside and the lock oil passage through which the hydraulic pressure is to be supplied to the one end surface of the lock pin, wherein the urging force of the urging member constituting the lock pin is set such that when the hydraulic pressure applied to the one end surface of the lock pin is equal to or higher than a first predetermined hydraulic pressure and lower than a second predetermined hydraulic pressure, the lock pin unlocks the housing and the rotor and interrupts communication between the lock oil passage and the foreign matter discharge oil passage, and when the hydraulic pressure applied to the one end surface of the lock pin is equal to or higher than the second predetermined hydraulic pressure, the lock pin unlocks the housing and the rotor and causes the lock oil passage and the foreign matter discharge oil passage to communicate with each other.

2. The variable valve timing mechanism according to claim 1, wherein the urging force of the urging member constituting the lock pin is set such that when the hydraulic pressure applied to the one end surface of the lock pin is lower than the first predetermined hydraulic pressure, the lock pin locks the housing and the rotor and interrupts the communication between the lock oil passage and the foreign matter discharge oil passage.

3. A variable valve timing mechanism including a housing configured to rotate in conjunction with a crankshaft of an engine, a rotor that is provided coaxially with the housing to be rotatable relative to the housing and is configured to rotate in conjunction with a camshaft, an advance oil chamber that oil is to enter to rotate the rotor to an advance side, a retard oil chamber that the oil is to enter to rotate the rotor to a retard side, the advance oil chamber and the retard oil chamber being defined by the housing and the rotor, and a controller configured to control supply and discharge of the oil to and from the advance oil chamber and the retard oil chamber, the variable valve timing mechanism being configured to vary a valve timing by controlling the supply and discharge of the oil to and from the advance oil chamber and the retard oil chamber depending on an operation state of the engine to rotationally adjust a phase difference between the housing and the rotor, the variable valve timing mechanism comprising:

a detent valve comprising a spool having one end coupled to a detent oil passage through which a hydraulic pressure is to be supplied, and having another end provided with an urging member configured to apply an urging force in a direction opposite to a direction of a pressing force of the hydraulic pressure, the spool being configured to slide in an axial direction according to a balance between the pressing force of the hydraulic pressure that is applied to one end surface and the urging force of the urging member that is applied to another end surface to switch oil passages to move the rotor to a predetermined lock position or to allow the rotor to rotate; and a foreign matter discharge oil passage that makes communication between an outside and the detent oil passage through which the hydraulic pressure is to be supplied to the one end surface of the spool constituting the detent valve, wherein the urging force of the urging member constituting the detent valve is set such that when the hydraulic pressure applied to the one end surface of the spool constituting the detent valve is lower than a first predetermined hydraulic pressure, the detent valve switches the oil passages to move the rotor to the predetermined lock position and interrupts communication between the detent oil passage and the foreign matter discharge oil passage, when the hydraulic pressure applied to the one end surface of the spool constituting the detent valve is equal to or higher than the first predetermined hydraulic pressure and lower than a second predetermined hydraulic pressure, the detent valve switches the oil passages to allow the rotor to rotate and interrupts the communication between the detent oil passage and the foreign matter discharge oil passage, and when the hydraulic pressure applied to the one end surface of the spool constituting the detent valve is equal to or higher than the second predetermined hydraulic pressure, the detent valve switches the oil passages to allow the rotor to rotate and causes the detent oil passage and the foreign matter discharge oil passage to communicate with each other.

4. The variable valve timing mechanism according to claim 2, further comprising an oil pump to be driven by the engine and configured to pressurize and discharge the oil, wherein a discharge pressure of the oil pump is set equal to or higher than the second predetermined hydraulic pressure when an oil temperature is lower than a predetermined oil temperature and/or a rotational speed is equal to or higher than a predetermined rotational speed, and the discharge pressure of the oil pump is set lower than the second predetermined hydraulic pressure and equal to or higher than the first predetermined hydraulic pressure when the oil temperature is equal to or higher than the predetermined oil temperature and/or the rotational speed is lower than the predetermined rotational speed.

5. The variable valve timing mechanism according to claim 3, further comprising an oil pump to be driven by the engine and configured to pressurize and discharge the oil, wherein a discharge pressure of the oil pump is set equal to or higher than the second predetermined hydraulic pressure when an oil temperature is lower than a predetermined oil temperature and/or a rotational speed is equal to or higher than a predetermined rotational speed, and the discharge pressure of the oil pump is set lower than the second predetermined hydraulic pressure and equal to or higher than the first predetermined hydraulic pressure when the oil temperature is equal to or higher than the predetermined oil temperature and/or the rotational speed is lower than the predetermined rotational speed.

6. The variable valve timing mechanism according to claim 4, wherein another end of the foreign matter discharge oil passage communicates with a crankcase, and the oil is discharged to the crankcase.

7. The variable valve timing mechanism according to claim 5, wherein another end of the foreign matter discharge oil passage communicates with a crankcase, and the oil is discharged to the crankcase.

* * * * *